US012669291B2

(12) United States Patent
Yoo et al.

(10) Patent No.: US 12,669,291 B2
(45) Date of Patent: Jun. 30, 2026

(54) PLATE HEAT EXCHANGER

(71) Applicant: LG ELECTRONICS INC., Seoul (KR)

(72) Inventors: Sanghoon Yoo, Seoul (KR); Eungyul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 110 days.

(21) Appl. No.: 18/582,345

(22) Filed: Feb. 20, 2024

(65) Prior Publication Data

US 2024/0280328 A1 Aug. 22, 2024

(30) Foreign Application Priority Data

Feb. 20, 2023 (KR) ..... 10-2023-0021970

(51) Int. Cl.

| | |
|---|---|
| ***F28F 9/02*** | (2006.01) |
| ***F28D 9/00*** | (2006.01) |
| ***F28F 3/02*** | (2006.01) |
| ***F28F 3/08*** | (2006.01) |
| ***F28F 3/10*** | (2006.01) |

(52) U.S. Cl.

CPC ..... *F28D 9/0075* (2013.01)

(58) Field of Classification Search

CPC ..... F28D 9/0043; F28D 9/005; F28F 3/02; F28F 3/025; F28F 3/08; F28F 3/086; F28F 3/10; F28F 2275/04; F28F 9/026; F28F 9/0265; F28F 9/0268

See application file for complete search history.

(56) References Cited

U.S. PATENT DOCUMENTS

| | | | | |
|---|---|---|---|---|
| 2013/0192291 | A1 | 8/2013 | Ito et al. | |
| 2013/0327513 | A1* | 12/2013 | Franz | F28F 3/048 165/185 |
| 2014/0182322 | A1* | 7/2014 | Ito | F28F 3/046 62/324.1 |
| 2016/0107661 | A1* | 4/2016 | Cooper | B61L 15/0072 246/167 R |
| 2021/0278138 | A1* | 9/2021 | Yoo | F28F 3/046 |
| 2021/0341228 | A1* | 11/2021 | Tissot | F28D 9/0043 |

FOREIGN PATENT DOCUMENTS

| | | | |
|---|---|---|---|
| GB | 867869 | A | 5/1961 |
| JP | 5805189 | B2 | 11/2015 |
| KR | 10-2008-0006122 | A | 1/2008 |

(Continued)

*Primary Examiner* — Frantz F Jules
*Assistant Examiner* — Jason N Thompson
(74) *Attorney, Agent, or Firm* — Birch, Stewart, Kolasch & Birch, LLP

(57) ABSTRACT

A plate heat exchanger includes a first plate having a first heat transfer region through which a first fluid flows, a first inlet into which the first fluid flows, and a first discharge portion through which the first fluid is discharged, and a second plate having a second heat transfer region through which a second fluid flows, a second inlet into which the second fluid flows, and a second discharge portion through which the second fluid is discharged, and stacked on the first plate. The first plate further includes a flat portion disposed to surround the first inlet portion, and the flat portion has an asymmetrical shape with respect to the first inlet.

17 Claims, 8 Drawing Sheets

(56) References Cited

FOREIGN PATENT DOCUMENTS

| | | | |
|---|---|---|---|
| KR | 10-2013-0095575 | A | 8/2013 |
| KR | 10-2020-0041600 | A | 4/2020 |
| KR | 10-2115918 | B1 | 5/2020 |
| WO | WO 2021/177737 | A1 | 9/2021 |
| WO | WO 2022/206792 | A1 | 10/2022 |

* cited by examiner

PLATE HEAT EXCHANGER

CROSS REFERENCE TO RELATED APPLICATION

This non-provisional application claims the benefit under 35 U.S.C. § 119(a) to Patent Application No. 10-2023-0021970, filed in the Republic of Korea on Feb. 20, 2023, all of which is hereby incorporated by reference into the present application.

BACKGROUND

Field

The present disclosure relates to a plate heat exchanger. In particular, the present disclosure relates to a plate heat exchanger capable of preventing freezing and breaking by resolving stagnation of flow of water adjacent to a discharge portion.

Related Art

In general, an air conditioner refers to a device that cools and heats a room through a process of compression, condensation, expansion, and evaporation of a refrigerant. When heating a room, an indoor heat exchanger provided in an indoor unit functions as a condenser through which a high-temperature and high-pressure refrigerant passes, and an outdoor heat exchanger provided in an outdoor unit functions as an evaporator through which a low-temperature and low-pressure refrigerant passes. Conversely, when cooling a room, the indoor heat exchanger functions as an evaporator and the outdoor heat exchanger functions as a condenser.

Such a heat exchanger is provided as a plate heat exchanger so that heat transfer between different fluids (that is, water and refrigerant) can be effectively achieved. For example, Korean Patent Publication No. 10-2008-0006122 discloses a configuration in which heat exchange can be efficiently performed in a channel formed between a plurality of heat transfer plates.

In particular, in the case of cooling high-temperature water using a low-temperature refrigerant, freezing of water may be accelerated as a flow of water adjacent to a discharge portion is stagnant, and thus, there is a need for technology development to solve this problem.

PRIOR ART LITERATURE

Patent Literature (Patent Document 0001) Korean Laid-Open Patent Publication 10-2008-0006122 (Jan. 16, 2008)

SUMMARY

An object of the present disclosure is to provide a plate heat exchanger capable of preventing refrigerant from not flowing into a heat transfer plate having a ridge and a groove around an inlet of a refrigerant, resolving stagnation of the refrigerant, and preventing freezing and bursting of the heat exchanger.

In addition, another object of the present disclosure is to provide a plate heat exchanger capable of solving the problem that the refrigerant does not flow into the groove due to gravity at the side far from a refrigerant inlet of the plate.

In addition, still another object of the present disclosure is to provide a plate heat exchanger capable of securing a region in which a ridge and a groove are not formed in a plate to expand a welding area and prevent leakage caused by welding defects.

According to an aspect of the present disclosure, there is provided a plate heat exchanger including: a first plate having a first heat transfer region through which a first fluid flows, a first inlet into which the first fluid flows, and a first discharge portion through which the first fluid is discharged; and a second plate having a second heat transfer region through which a second fluid flows, a second inlet into which the second fluid flows, and a second discharge portion through which the second fluid is discharged, and stacked on the first plate, in which the first plate further includes a flat portion disposed to surround the first inlet, and the flat portion has an asymmetrical shape with respect to the first inlet.

The first heat transfer region may include a ridge and a groove having a step with respect to the ridge.

The flat portion may have a step with respect to the ridge.

The flat portion may be located on the same plane as an apex of the groove.

At least a portion of the groove may communicate with the flat portion.

The first heat transfer region may be located between the first inlet and the discharge portion.

The flat portion may include a first region located between a center of the first inlet and the groove, and a second region other than the first region.

A width of the first region may be maintained constant along a periphery of the first inlet.

The second region may have a shape that is asymmetric in a left-right direction with respect to the center of the first inlet.

The second region may include a first boundary surface having one end adjacent to one end of the first plate and the other end connected to the groove, and a second boundary surface having one end adjacent to one end of the first plate, and a distance between the first boundary surface and the second boundary surface may increase as it approaches the center of the first inlet part.

The first boundary surface may have a straight-line shape, and the second boundary surface has a curved shape having a curvature.

The first boundary surface may extend in a direction perpendicular to one end of the first plate.

The second boundary surface may have an acute angle of inclination with one end of the first plate.

The second boundary surface may have an inclination of 25 degrees to 35 degrees from one end of the first plate.

The second region may further include a third boundary surface connecting one end of the first boundary surface and one end of the second boundary surface.

The first boundary surface may be disposed not to overlap the first inlet in a vertical direction.

A portion of the second boundary surface may be arranged to overlap the first inlet in a vertical direction.

The first plate further may include a protrusion protruding from the flat portion between the first boundary surface and the second boundary surface.

The protrusion may be located to overlap the first inlet in an up-down direction.

The first plate may further include a first channel region connected to one end of the first heat transfer region and formed with the first inlet, and a low-temperature fluid flow portion formed in the first channel region and through which the second fluid passes, and a boundary between the first channel region and the first heat transfer region may be inclined upward toward one side of the first passage region.

The first plate may further include a coupling reinforcing portion having a step with respect to the groove between a boundary between the first channel region and the first heat transfer region and the low-temperature fluid flow portion.

According to another aspect of the present disclosure, there is provided a plate heat exchanger including: a first plate having a first heat transfer region through which a first fluid flows, a first inlet into which the first fluid flows, and a first discharge portion through which the first fluid is discharged; and a second plate having a second heat transfer region through which a second fluid flows, a second inlet into which the second fluid flows, and a second discharge portion through which the second fluid is discharged, and stacked on the first plate, in which the first plate further includes a flat portion disposed to surround the first inlet, and a width of the flat portion is maximum in a direction between a right side and a lower side of the first inlet.

According to another aspect of the present disclosure, there is provided a plate heat exchanger including: a first plate having a first heat transfer region through which a first fluid flows, a first inlet into which the first fluid flows, and a first discharge portion through which the first fluid is discharged; and a second plate having a second heat transfer region through which a second fluid flows, a second inlet into which the second fluid flows, and a second discharge portion through which the second fluid is discharged, and stacked on the first plate, in which the first plate further includes a flat portion disposed to surround the first inlet, and a width of the flat portion between a right side and a lower side of the first inlet is greater than a width of the flat portion on the right side of the first inlet and a width of the flat portion on a left side of the first inlet.

DESCRIPTION OF EXEMPLARY EMBODIMENTS

Figure 1:
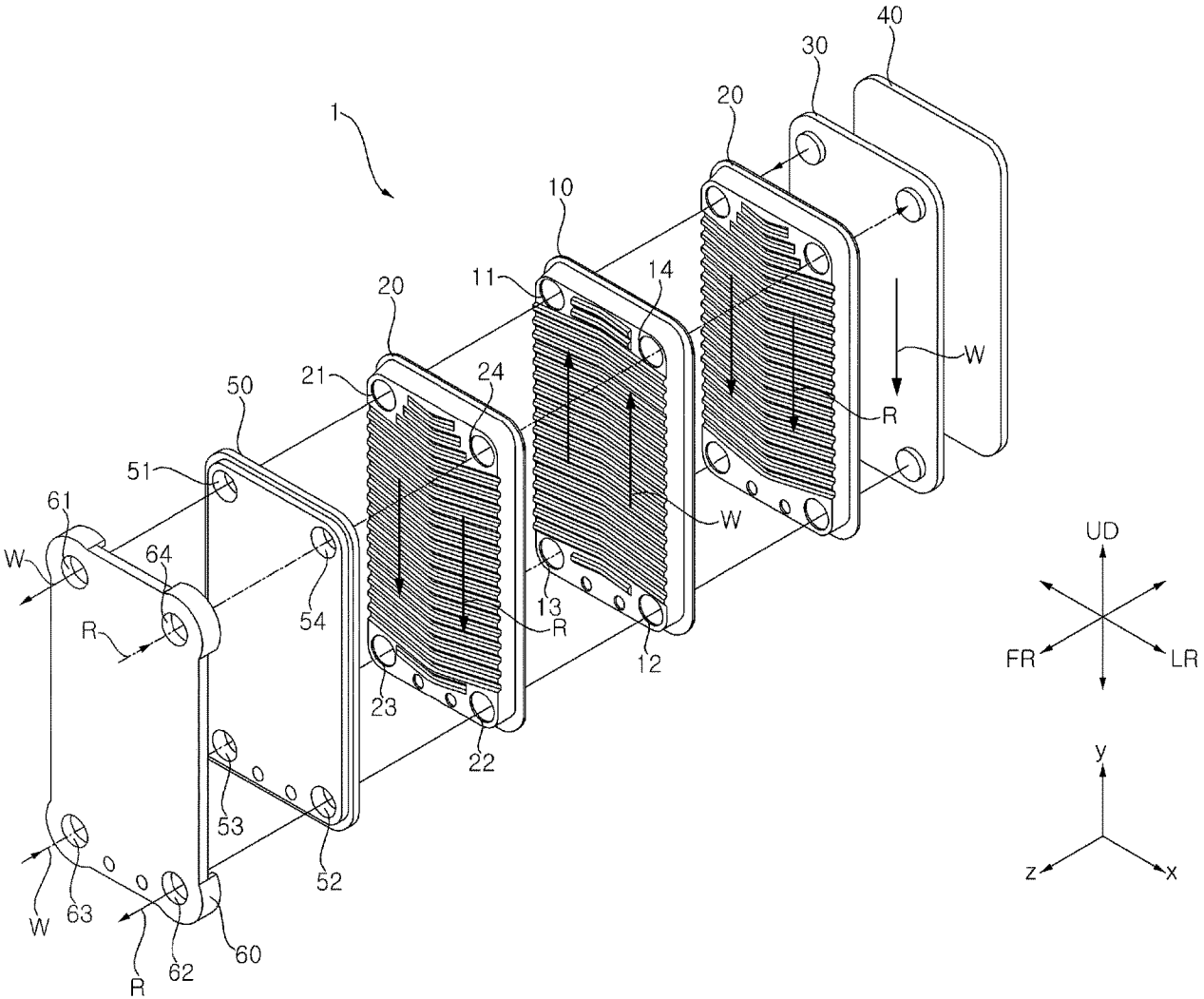
FIG. 1 is a perspective view of a plate heat exchanger according to one embodiment of the present disclosure.

Advantages and features of the present disclosure and methods for achieving those of the present disclosure will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope of the present disclosure. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Hereinafter, exemplary embodiments of the present disclosure will be described with reference to the accompanying drawings.

Referring to FIG. 1, a plate heat exchanger 1 includes a plurality of plates 10 and 20 stacked on each other.

A direction in which the plurality of plates 10 and 20 are mutually stacked in the plate heat exchanger 1 may be referred to as a front-rear direction FR. Moreover, the plurality of plates 10 and 20 may extend long in an up-down direction UD.

A left-right direction LR may be a direction perpendicular to the front-rear direction FR and the up-down direction UD. Meanwhile, for convenience of description, a length of the plate heat exchanger 1 in the up-down direction UD is illustrated and described as longer than a length thereof in the left-right direction LR, but the length of the plate heat exchanger 1 in the up-down direction UD may be approximately equal to or shorter than the length thereof in the left-right direction LR.

Although it is illustrated that three plates 10 and 20 of the plate heat exchanger 1 are provided, the number of the plurality of plates 10 and 20 is not limited.

A first end plate 50 may cover the front of the plate located at the forefront among the plurality of plates 10 and 20. In this case, a channel through which fluid flows may be formed between the first end plate 50 and the foremost plate.

The second end plate 30 may cover the rear of a plate located at the rearmost of the plurality of plates 10 and 20. In this case, a channel through which the fluid flows may be formed between the second end plate 30 and the rearmost plate. Moreover, the flow of fluid from the second end plate 30 to the rear side may be blocked.

A front cover 60 may be coupled to the first end plate 50 to cover the front of the first end plate 50. A rear cover 40 may be coupled to the second end plate 30 to cover the rear of the second end plate 50.

Holes through which a first fluid W and a second fluid R are introduced or discharged may be formed in the front cover 60, the first end plate 50, and the plurality of plates 10 and 20, respectively.

For example, the first fluid W is introduced through an inlet 63 of the front cover 60, and may flow through a first channel which connects an inlet 53 of the first end plate 50 and inlets of 13 and 23 the plurality of plates 10 and 20. In addition, a portion of the first fluid W flowing through the first channel may flow upward along heat transfer surfaces of some of the plurality of plates 10 and 20.

In addition, the first fluid W flowing through the first channel and/or the heat transfer surface may be combined in the second channel and discharged to the outside through the discharge portion 61 of the front cover 60. Here, the second passage may connect the discharge portions 11 and 21 of the plurality of plates 10 and 20 and the discharge portion 52 of the first end plate 50. Meanwhile, the first fluid W may be water.

For example, the second fluid R may be introduced through the inlet 64 of the front cover 60, and then, may flow to a third channel which connects the inlet 54 of the first end plate 50 and the inlets 14 and 24 of the plurality of plates 10 and 20. Moreover, a portion of the second fluid R flowing through the third channel may flow downward along the heat transfer surfaces of some of the plurality of plates 10 and 20.

In addition, the second fluid R flowing through the third channel and/or the heat transfer region may be combined in a fourth channel and discharged to the outside through the discharge portion 62 of the front cover 60. Here, the fourth channel may connect the discharge portions 12 and 22 of the plurality of plates 10 and 20 and the discharge portion 52 of the first end plate 50. Meanwhile, the second fluid R may be a refrigerant. For example, the second fluid R may be R410A or R32.

For example, the first fluid W may flow into the inlet 63 of the front cover 60 in a relatively high temperature state and pass through the inside of the plate heat exchanger 1. In this case, the second fluid R may flow into the inlet 63 of the front cover 60 in a relatively low temperature state, pass through the inside of the plate heat exchanger 1, and exchange heat with the first fluid W. As a result, the first fluid W may be cooled, and the second fluid R may be heated.

Figure 2A:
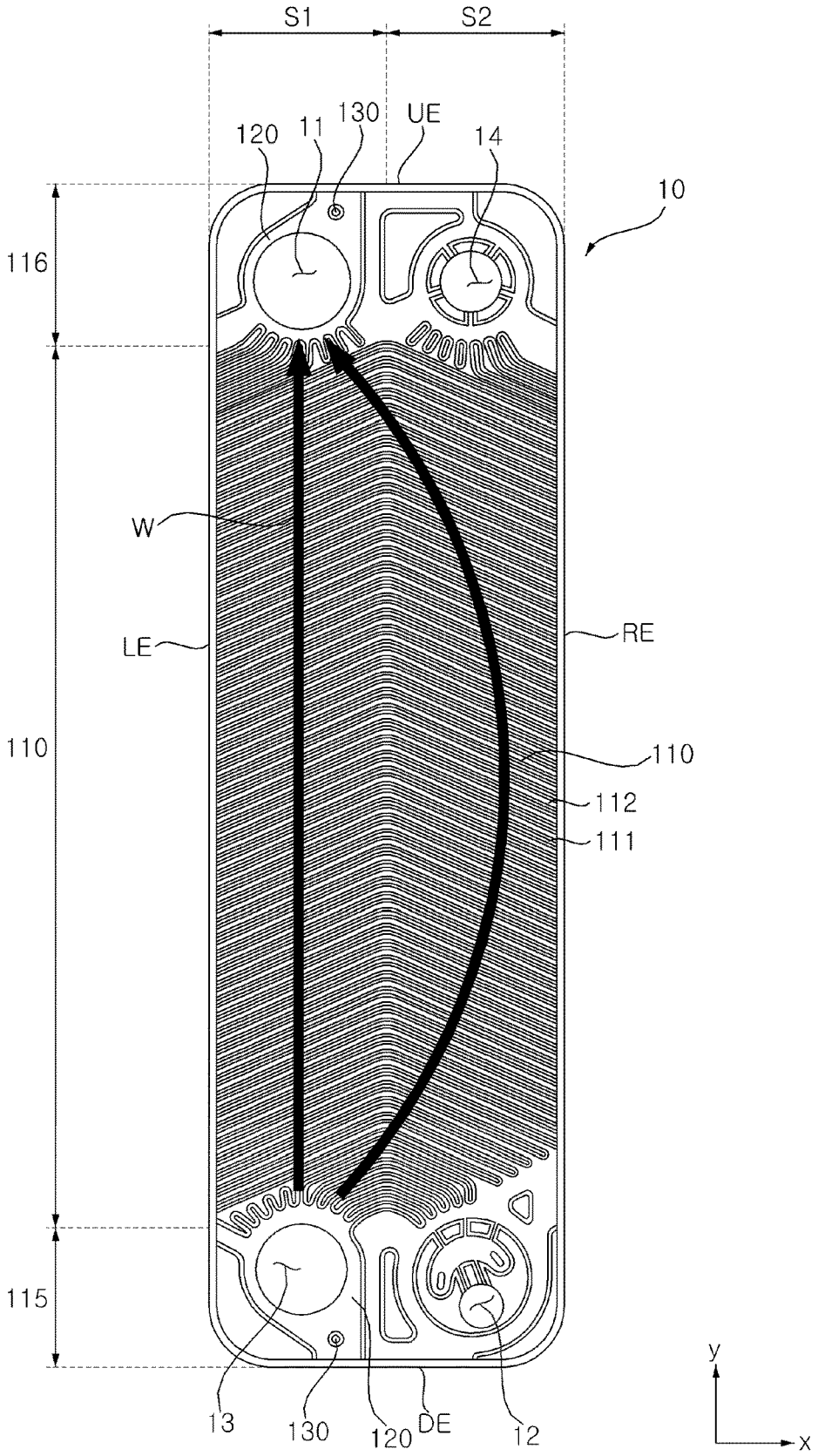
FIG. 2A is a front view of a first plate according to one embodiment of the present disclosure.

FIG. 2A is a front view of a first plate 10 according to one embodiment of the present disclosure.

Referring to FIG. 2A, the plurality of plates 10 and 20 may include the first plate 10 and the second plates 20 stacked on each other in the front-rear direction FR. In this case, the first plate 10 may include a first heat transfer region 110 through which the first fluid W flows.

The first plate 10 may include a first inlet 13 to which the first fluid W flowing through the first heat transfer region 110 is introduced, and a first discharge portion 11 through which the first fluid W is discharged.

For example, the first fluid W introduced into the first inlet 13 may flow along the first heat transfer region 110 and be discharged through the first discharge portion 11. Meanwhile, the second fluid R may pass through low-temperature fluid flow portions 12 and 14 of the first plate 10 without flowing into the first heat transfer region 110 of the first plate 10.

The first plate 10 may be partitioned into a first heat transfer region 110 and first channel regions 115 and 116. The first heat transfer region 110 may be located between the two first channel regions 115 and 116.

Specifically, one end of the first heat transfer region 110 may be connected to one end of the first channel regions 115 and 116. More specifically, the first channel regions 115 and 116 may be located at upper and lower ends of the first heat transfer region 110, respectively. The first heat transfer region 110 may be located between the first inlet 13 and the first discharge portion 11.

The first channel regions 115 and 116 may include a first lower channel region 115 connected to the lower end of the first heat transfer region 110 and a first upper channel region 116 connected to the upper end of the first heat transfer region 110.

The low-temperature fluid flow portions 12 and 14 include an upper low-temperature fluid flow portion 14 and a lower low-temperature fluid flow portion 12. The lower low-temperature fluid flow portion 12 and the first inlet 13 are located in the first lower channel region 115. The upper low-temperature fluid flow portion 14 and the first discharge portion 11 are located in the first upper channel region 116.

The first plate 10 may be partitioned into the first heat transfer region 110 and two first channel regions 115 and 116 located at both ends of the first heat transfer region 110 in the up-down direction (longitudinal direction), and may be partitioned into a left region S1 and a right region S2 in the left-right direction.

The right end of the left region S1 and the left end of the right region S2 are connected. The upper low-temperature fluid flow portion 14 and the lower low-temperature fluid flow portion 12 are located in the right region S2, and the first inlet 13 and the first discharge portion 11 are located in the left region S1.

The first heat transfer region 110 of the first plate 10 may include a ridge 111 and a groove 112 having a step (height difference) with respect to the ridge 111. The groove 112 is located between two adjacent ridges 111.

It may be a wave shape in which the ridges 111 and the grooves 112 are alternately formed.

For example, the wave of the first heat transfer region 110 may be formed in an inverted-V shape or a V shape on the front side. The shape of the first heat transfer region 110 may be referred to as a chevron shape. Accordingly, the heat transfer area of the first fluid W flowing through the first heat transfer region 110 may be increased.

The ridge 111 and the groove 112 of the first heat transfer region 110 may extend in a left-right direction. More specifically, the direction of the ridge 111 and the groove 112 of the first heat transfer region 110 may be switched at the boundary between the left region S1 and the right region S2. The ridge 111 and the groove 112 of the first heat transfer region 110 may be inclined upward toward a boundary between the left region S1 and the right region S2 from a left end LE of the first plate 10, and may be inclined downward toward a right end from the boundary between the left region S1 and the right region S2.

The first plate 10 may further include a flat portion 120 disposed to surround the first inlet 13. A protrusion 130 may be disposed in the flat portion 120.

The flat portion 120 and the protrusion 130 will be described later with reference to FIG. 4.

Figure 2B:
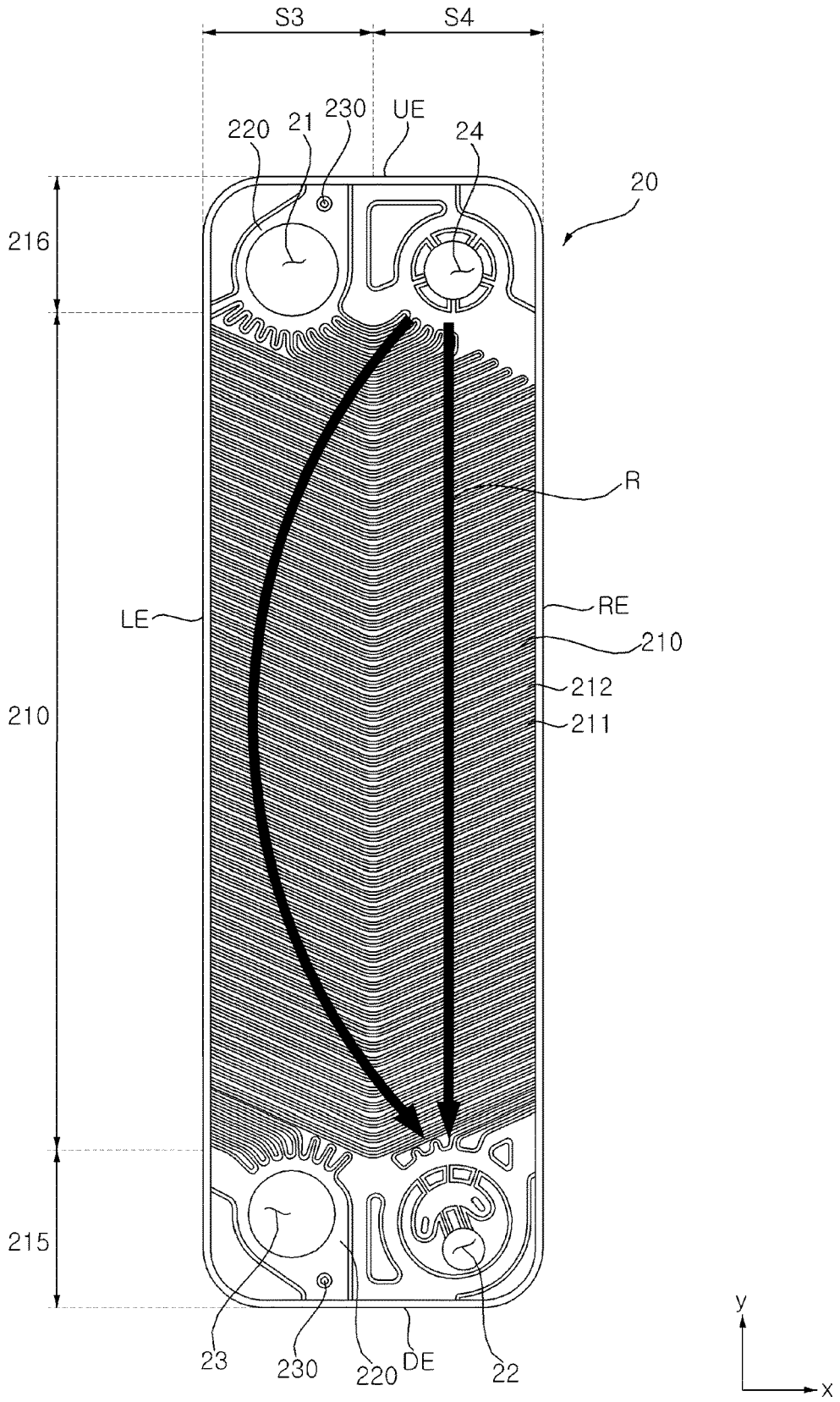
FIG. 2B is a front view of a second plate according to one embodiment of the present disclosure.
Figure 3:
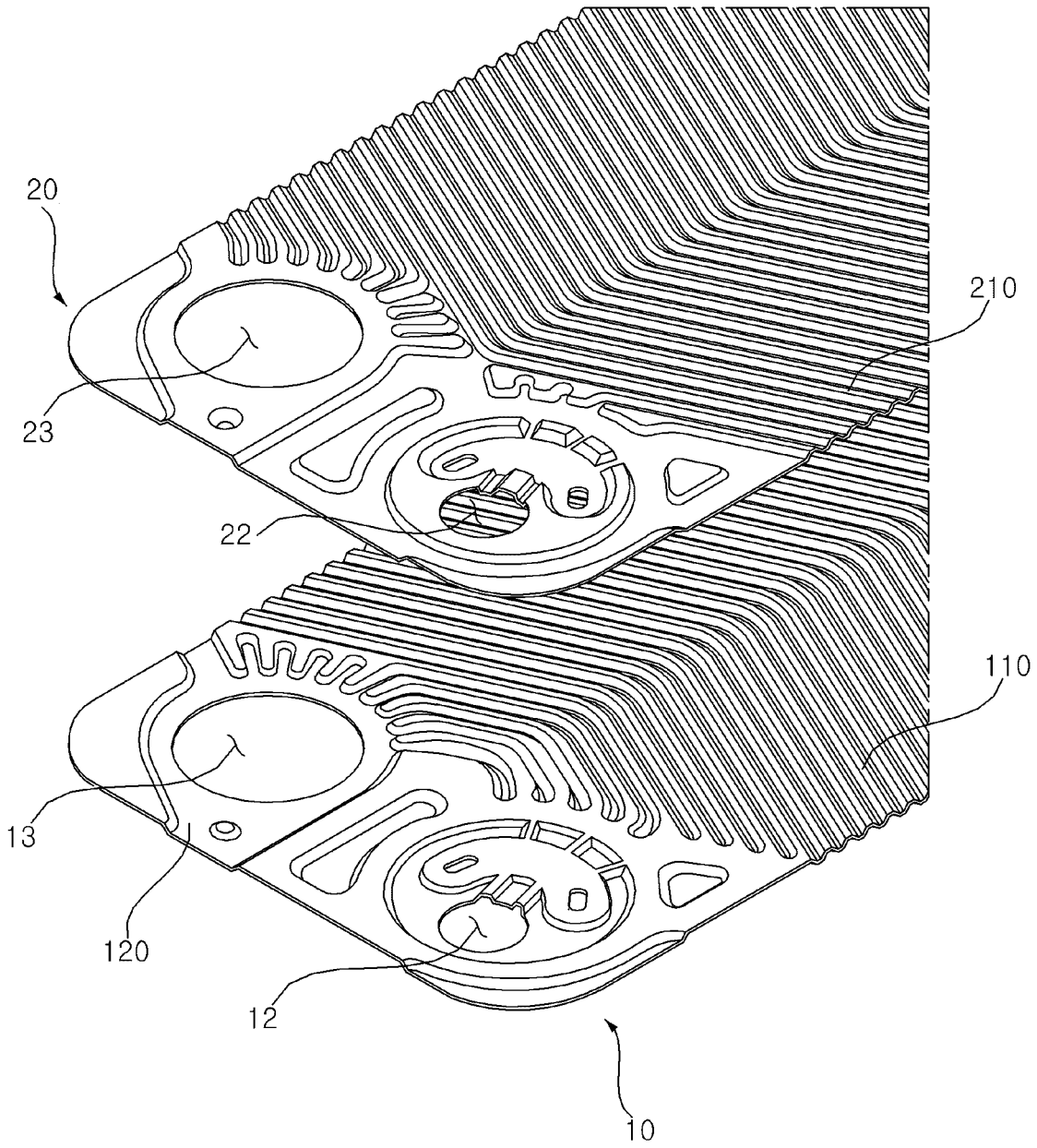
FIG. 3 is an exploded perspective view of the first plate and the second plate according to one embodiment of the present disclosure.

FIG. 2B is a front view of the second plate 20 according to one embodiment of the present disclosure.

Referring to FIG. 2B, the second plate 20 may include a second heat transfer region 210 through which the second fluid R flows.

The second plate 20 may include a second inlet 24 into which the second fluid R flowing through the second heat transfer region 210 is introduced and a second discharge portion 22 through which the second fluid R is discharged.

For example, the second fluid R introduced into the second inlet 24 may flow along the second heat transfer region 210 and be discharged through the second discharge portion 22. Meanwhile, the first fluid W may pass through the high-temperature fluid flow portions 21 and 23 of the second plate 20 without flowing into the second heat transfer region 210 of the second plate 20.

The second plate 20 may be partitioned into a second heat transfer region 210 and second channel regions 215 and 216. The second heat transfer region 210 may be located between the two second channel regions 215 and 216.

Specifically, one end of the second heat transfer region 210 may be connected to one end of the second channel regions 215 and 216. More specifically, the second channel regions 215 and 216 may be located at upper and lower ends of the second heat transfer region 210, respectively.

The second channel regions 215 and 216 may include a second lower channel region 215 connected to a lower end of the second heat transfer region 210, and a second upper channel region 216 connected to an upper end of the second heat transfer region 210.

The high-temperature fluid flow portions 21 and 23 include an upper high-temperature fluid flow portion 21 and a lower high-temperature fluid flow portion 23. The lower high-temperature fluid flow portion 23 and the second discharge portion 22 are located in the second lower channel region 215. The upper high-temperature fluid flow portion 21 and the second inlet 24 are located in the second upper channel region 216.

The second plate 20 may be partitioned into the second heat transfer region 210 and two second channel regions 215 and 216 located at both ends of the second heat transfer region 210 in the up-down direction (longitudinal direction), and may be partitioned into a left region S3 and a right region S4 in the left-right direction.

The right end of the left region S3 and the left end of the right region S4 are connected. The second inlet 24 and the second discharge portion 22 are located in the left region S3, and the second upper high-temperature fluid flow portion 21 and the second lower high-temperature fluid flow portion 23 are located in the right region S4.

The second heat transfer region 210 of the second plate 20 may include a ridge 211 and a groove 212 having a step with respect to the ridge 211. The groove 212 is located between two adjacent ridges 211.

It may have a wave shape in which the ridge 211 and the groove 212 are alternately formed.

For example, the wave of the second heat transfer region 210 may be formed in a V shape or an inverted-V shape on the front side. The shape of the second heat transfer region 210 may be referred to as a chevron shape. Accordingly, a heat transfer area of the second fluid R flowing through the second heat transfer region 210 may be increased.

The ridge 211 and the groove 212 of the second heat transfer region 210 may extend in the left-right direction. More specifically, the direction of the ridge 211 and the groove 212 of the second heat transfer region 210 may be switched at a boundary between the left region S3 and the right region S4. The ridge 211 and the groove 212 of the second heat transfer region 210 may be inclined downward toward the boundary between the left region S3 and the right region S4 from the left end of the second plate 20, and may be inclined upward toward the right end from the boundary between S3 and the right region S4.

The second plate 20 may further include a flat portion 220 disposed to surround the high-temperature fluid flow portions 21 and 23. A protrusion 230 may be disposed in the flat portion 220.

Figure 4:
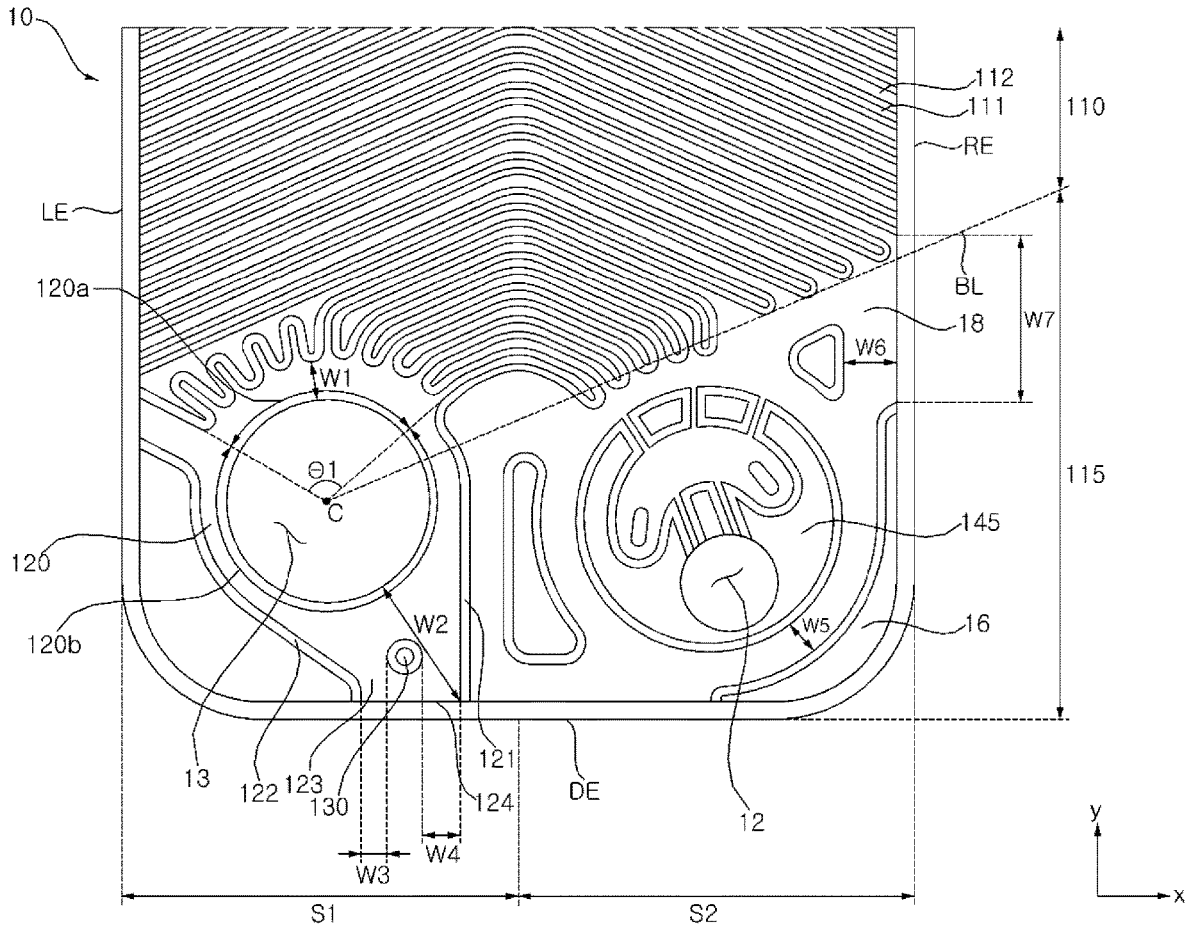
FIG. 4 is a view illustrating a structure capable of resolving stagnation in flow of water adjacent to an inlet according to one embodiment of the present disclosure.

FIG. 4 is a view illustrating a structure capable of resolving stagnation in flow of water adjacent to the inlet according to one embodiment of the present disclosure.

Referring to FIG. 4, the ridge 111 may be formed while being pressed on the first plate 10. In this case, a plurality of grooves 112 may be formed between the plurality of ridges 111. Moreover, the flat portion 120 of the first plate 10 may be formed stepwise with respect to the ridge 111.

The flat portion 120 may be formed to surround the first inlet 13. The flat portion 120 may have a shape in which a portion of the ring shape surrounding the first inlet 13 is expanded. Accordingly, the flat portion 120 may be located in the left region S1 of the first lower channel region 115.

The lower end of the first heat transfer region 110 may be located along the periphery of the flat portion 120. That is, the first fluid W introduced through the first inlet 13 passes through the flat portion 120 and flows along the ridges 111 and the grooves 112 of the first heat transfer region 110. At least some of the groove 112 may communicate with the flat portion 120. The flat portion 120 may be located on the same plane as the apex of the groove 112.

The flat portion 120 may include a first region 120*a* and a second region 120*b*. The first region 120*a* may be adjacent to the first heat transfer region 110 and may be located between a center C of the first inlet 13 and the groove 112.

That is, the first region 120*a* may be a region adjacent to the groove 112. The second region 120*b* may be a region of the flat portion 120 other than the first region 120*a*. That is, the second region 120*b* may be a region spaced apart from the groove 112.

For example, the first inlet 13 is a circular hole, and the first region 120*a* and the second region 120*b* may be fan-shaped with respect to the center C of the first inlet 13 and may have a shape other than the region where the first inlet 13 is located.

In this case, a portion of the second region 120*b* may be adjacent to a lower end DE of the first plate 10 or connected to the lower end DE of the first plate 10. A central angle θ1 of the first region 120*a* may be 80 degrees to 150 degrees.

A width W1 of the first region 120*a* may be maintained constant along the periphery of the first inlet 13. That is, the first region 120*a* may be a portion of a ring shape having a constant width. Of course, the width of the first region 120*a* may be changed along the periphery. Here, the width of the flat portion 120 means a radial direction measured from the center of the first inlet 13. Specifically, the first region 120*a* may be adjacent to the left end LE of the first plate 10 or connected to the left end LE of the first plate 10. That is, the width of the first region 120*a* may be constant in the upper right portion and may be extended in a portion of the upper left portion.

Meanwhile, the first inlet 13 may be located to be adjacent to the second discharge portion 22 of the second plate 20 through which the second fluid R is discharged and the lower low-temperature fluid flow portion 12 of the first plate 10 through which the second fluid R passes.

Moreover, in the case where the relatively high temperature first fluid W passes through the plate heat exchanger 1 and is cooled by the relatively low temperature second fluid R, the first fluid W (that is, fluid cooled to a certain level or higher) passing through the first inlet 13 may be frozen by the second fluid R (that is, low-temperature fluid) passing through the second discharge portion 22 or the lower low-temperature fluid flow portion 12. In this case, when the flow of the first fluid W in the first inlet 13 is stagnant, the above-described freezing is accelerated and the plate heat exchanger 1 may freeze and burst, and it is necessary to solve this problem.

Accordingly, in the present disclosure, in order to prevent stagnation of the first fluid W, the flat portion 120 may have an asymmetrical shape with respect to the first inlet 13 as the center. The first fluid W introduced through the first inlet 13 spreads in all directions due to pressure and is slightly biased downward due to gravity.

In this case, when the lower side of the first inlet 13 has a symmetrical shape, the first fluid W is stagnant at the lower end of the first inlet 13 due to gravity. When the flat portion 120 surrounding the first inlet 13 has an asymmetrical shape, the pressure of the fluid introduced from the first inlet 13 and the action of gravity act to move the fluid in one direction. Therefore, it is possible to provide a moving force for moving the first fluid W on the lower side of the first inlet 13.

The first region 120*a* may have a left-right symmetrical shape with respect to a vertical line passing through the center of the first inlet 13. The second region 120*b* may have an asymmetric shape with respect to the left-right direction based on the center of the first inlet 13. Specifically, the second region 120*b* may have a left-right asymmetrical shape with respect to a vertical line passing through the center of the first inlet 13.

A width of the flat portion 120 may be maximum in a direction between the right side and the lower side of the first inlet 13. The width of the flat portion 120 may be maximized in the second region 120*b* between the right side and the lower side of the first inlet 13.

The width of the flat portion 120 between the right side and the lower side of the first inlet 13 may be greater than the width of the flat portion 120 on the right side of the first inlet 13 and the width of the flat portion 120 on the left side of the first inlet 13.

A width W2 of the second region 120*b* is not constant along the periphery of the first inlet 13, and a width of a region of the second region 120*b* located on the right side of the lower portion of the center of the first inlet 13 may be greater than a width of a region of the second region 120*b* located on the left side of the lower portion of the center of the first inlet 13.

For example, the second region 120*b* may include a first boundary surface 121 and a second boundary surface 122. The first boundary surface 121 and the second boundary surface 122 may define the boundary of the second region 120*b*.

One end of the first boundary surface 121 may be connected to one end of the first plate 10 and the other end thereof may be connected to the groove 112. Specifically, the lower end of the first boundary surface 121 may be connected to the lower end DE of the first plate 10, and the upper end of the first boundary surface 121 may be connected to the groove 112. Of course, depending on embodiments, the lower end of the first boundary surface 121 may be located to be adjacent to the lower end DE of the first plate 10.

One end of the second boundary surface 122 may be connected to one end of the first plate 10 and the other end may be connected to the other end intersecting one end of the first plate 10. Specifically, the lower end of the second boundary surface 122 may be connected to the lower end DE of the first plate 10, and the upper end of the second boundary surface 122 may be connected to the left end LE of the first plate 10.

Of course, depending on the embodiment, the lower end of the second boundary surface 122 may be located to be adjacent to the lower end DE of the first plate 10, and the upper end of the second boundary surface 122 may be connected to the groove 112.

A distance between the first boundary surface 121 and the second boundary surface 122 may increase as it approaches the center of the first inlet 13.

The lower end of the first boundary surface 121 and the lower end of the second boundary surface 122 may be connected to each other or may be spaced apart from each other. In the present embodiment, the lower end of the first boundary surface 121 and the lower end of the second boundary surface 122 are spaced apart from each other, and the lower end of the first boundary surface 121 and the lower end of the second boundary 122 may be connected by the third boundary surface 124. The third boundary surface 124 may be parallel to the lower surface of the first plate 10.

The first boundary surface 121 may have a straight-line shape, and the second boundary surface 122 may have a curved shape having a curvature. When the first boundary surface 121 has a straight-line shape and the second boundary surface 122 has a curved shape having a curvature, the first fluid W is introduced along the first boundary surface 121, and thus, easily flows out through the second inclined surface.

The first boundary surface 121 may extend in a direction perpendicular to one end of the first plate 10. The first boundary surface 121 may extend in a direction perpendicular to the lower end DE of the first plate 10.

The second boundary surface 122 may have an acute angle of inclination with one end of the first plate 10. The second boundary surface 122 may have an acute angle of inclination with the lower end DE of the first plate 10. Preferably, the second boundary surface 122 may have an inclination of 25 degrees to 35 degrees with respect to the lower end DE of the first plate 10.

The first boundary surface 121 may be disposed not to overlap the first inlet 13 in the up-down direction. The first boundary surface 121 may be located apart from the first inlet 13 to the right. The first boundary surface 121 may be located between the first inlet 13 and the lower low-temperature fluid flow portion 12.

A portion of the second boundary surface 122 may overlap the first inlet 13 in the up-down direction. A portion of the second boundary surface 122 may be spaced apart from the first inlet 13 in the left direction.

The third boundary surface 124 may be spaced apart from the center of the first inlet 13 in the right direction. The third boundary surface 124 may be located to be adjacent to the lower surface of the first plate 10.

The first plate 10 may further include a protrusion 130 protruding from the flat portion 120 between the first boundary surface 121 and the second boundary surface 122. The protrusion 130 may be located in a rotation region 123 between the first boundary surface 121 and the second boundary surface 122 in the second region 120*b*. The protrusion 130 may be located apart from the third boundary surface 124. The rotation region 123 is a portion of the second region 120*b*.

The protrusion 130 may be located to overlap the first inlet 13 in an up-down direction and not overlap with the center of the first inlet 13 in the up-down direction. Specifically, the protrusion 130 may be located in a rightward direction from the center of the first inlet 13.

The protrusion 130 prevents vortex from occurring in the rotation region 123 and serves to guide the flow direction of the first fluid W in the rotation region 123.

Therefore, the first fluid W introduced through the first inlet 13 descends along the first boundary surface 121, is converted while passing through the protrusion 130 and the third boundary surface 124, rises along the second boundary surface 122, and is introduced to the groove 112.

The protrusion 130 suppresses a collision between the first fluid W introduced directly to the discharge region through the first inlet 13 and the first fluid W descending along the first boundary surface 121 to guide the flow of the first fluid W.

The shape of the protrusion 130 is not limited, but may include a cylindrical column or a polygonal column. The size of the protrusion 130 is also not limited. When the size of the protrusion 130 is too wide, the space in which the first fluid W flows is reduced, resulting in a decrease in heat exchange efficiency. Moreover, when the size of the protrusion 130 is too small, the refrigerant introduced to the rotation region 123 through the first inlet 13 cannot be blocked.

Accordingly, the protrusion 130 preferably has a diameter or width that is 20% to 40% of the length of the third boundary surface 124.

Moreover, a horizontal separation distance W3 between the protrusion 130 and the second boundary surface 122 may be smaller than a horizontal separation distance W4 between the protrusion 130 and the first boundary surface 121. The horizontal separation distance W3 between the protrusion 130 and the second boundary surface 122 may be 0.6 to 0.8 times the horizontal separation distance W4 between the protrusion 130 and the first boundary surface 121.

Preferably, the width or diameter of the protrusion 130 is greater than the horizontal separation distance W3 between the protrusion 130 and the second boundary surface 122 and is smaller than the horizontal separation distance W4 between the protrusion 130 and the first boundary surface 121.

A boundary BL between the first channel regions 115 and 116 and the first heat transfer region 110 may be inclined upward toward one side of the first channel region 115 and 116.

Specifically, in the right region S2 of the first plate 10, a boundary BL between the first lower channel region 115 and the first heat transfer region 110 may be inclined upward toward the right end RE of the first plate 10 from the boundary between the left region S1 and the right region S2.

In the left region S1 of the first plate 10, the boundary BL between the first lower channel region 115 and the first heat transfer region 110 may match with the boundary of the first region 120*a* of the flat portion 120.

That is, the lower end of the groove 112 in the left region S1 of the first plate 10 may be located to be lower than the lower end of the groove 112 in the right region S2 of the first plate 10.

The first plate 10 may further include a coupling reinforcement portion 18 having a step with respect to the groove 112 between the boundary between the first channel regions 115 and 116 and the first heat transfer region 110 and the low-temperature fluid flow portion 12 and 14.

The coupling reinforcing portion 18 may have the same height as the ridge 111. The coupling reinforcing portion 18 may have a step with respect to the flat portion 120.

The coupling reinforcing portion 18 may be located to be adjacent to the right end RE of the first plate 10 in the right region S2 of the first plate 10.

As the distance to the right from the first inlet 13 increases, the action of gravity on the first fluid W introduced through the first inlet 13 becomes longer, and there is a problem that it is difficult for the first fluid W to flow into the groove 112 spaced from the first inlet 13 to the right.

The boundary BL between the first lower channel region 115 and the first heat transfer region 110 is inclined upward toward the right end RE of the first plate 10, and thus, there is an advantage in that the amount of first fluid W stagnant under the groove 112 spaced apart from the first inlet 13 in the right direction can be reduced.

The coupling reinforcing portion 18 secures a welding area when the first plate 10 and the second plate 20 are welded, thereby preventing leakage of fluid due to welding defects.

A coupling protrusion 146 having a step with respect to the coupling reinforcement portion 18 may be formed in the coupling reinforcement portion 18. The coupling protrusion 146 may be located to be spaced apart from the right end RE of the first plate 10. A distance W6 between the coupling protrusion 146 and the right end RE of the first plate 10 may be greater than the horizontal separation distance W3 between the protrusion 130 and the second boundary surface 122 and the horizontal separation distance W4 between the protrusion 130 and the first boundary surface 121.

A dead zone 16 may be located at the right end RE of the first plate 10 and a portion of the lower end of the first plate 10. The dead zone 16 may be disposed in the right region S2 of the first lower channel region 115 and may have a step with respect to the first lower channel region 115. Moreover, the dead zone 16 may have a step with respect to the ridge 111.

A vertical distance W7 between the upper end of the dead zone 16 and the first heat transfer region 110 may be greater than the distance W6 between the coupling protrusion 146 and the right end RE of the first plate 10, the horizontal separation distance W3 between the protrusion 130 and the second boundary surface 122, and the horizontal separation distance W between the protrusion 130 and the first boundary surface 121.

In addition, the first plate 10 may further include a peripheral portion 145 surrounding at least a portion of an edge of the lower low-temperature fluid flow portion 12. The peripheral portion 145 may be formed to have a step with respect to the ridge 111.

The peripheral portion 145 may be disposed to be spaced apart from the dead zone 16. Preferably, a distance W5 between the periphery 145 and the dead zone 16 is greater than the horizontal distance W3 between the protrusion 130 and the second boundary surface 122 and smaller than the horizontal separation distance W4 between the protrusion 130 and the first boundary surface 121.

Figure 5:
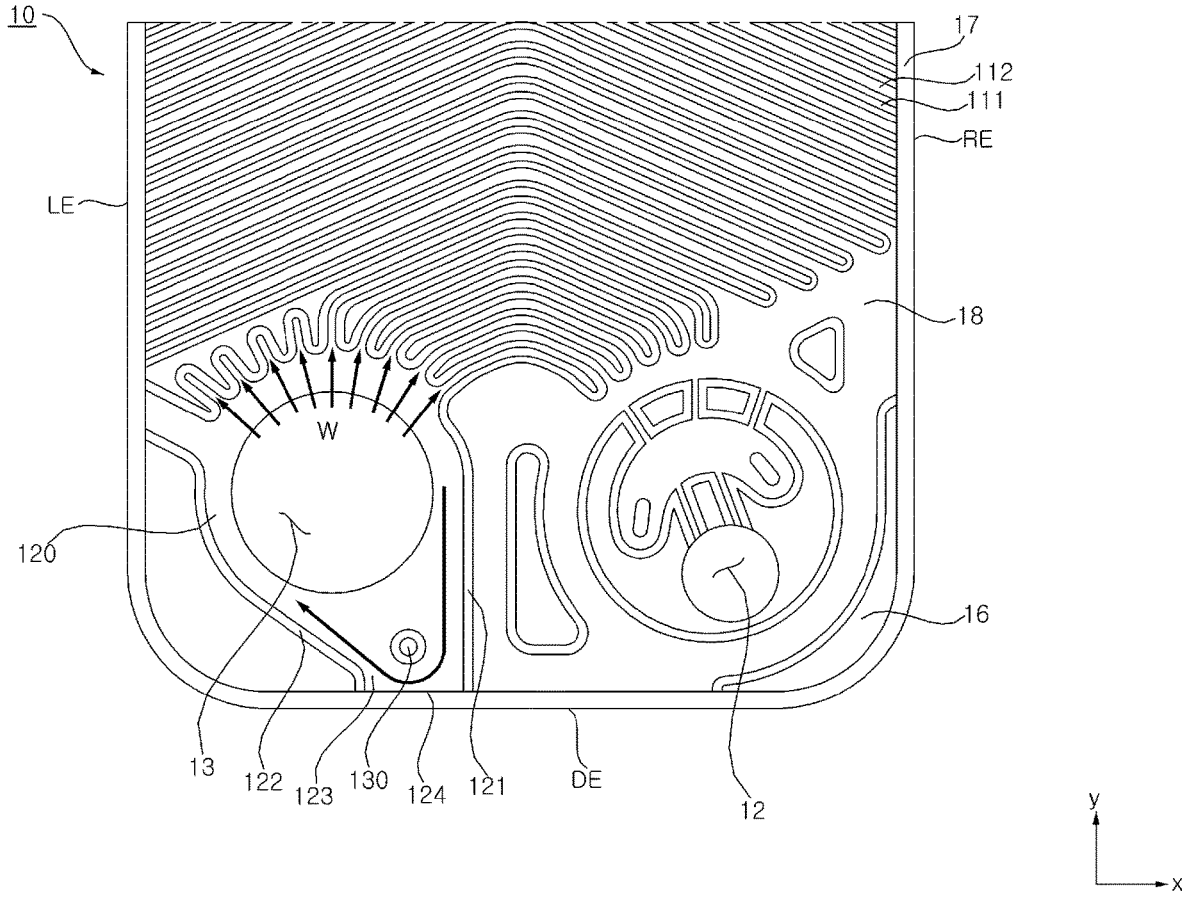
FIG. 5 is a view illustrating the flow of water adjacent to the inlet according to one embodiment of the present disclosure.

FIG. 5 is a view illustrating the flow of water adjacent to the inlet according to one embodiment of the present disclosure.

Referring to FIG. 5, a portion of water introduced through the first inlet 13 flows into the plurality of grooves 112 through the first region 120*a* of the flat portion 120. The other portion of the water introduced through the first inlet 13 moves downward by gravity, and is guided upward again by the shape of the second region 120*b* of the flat portion 120 and the protrusion 130 to flows into the plurality of grooves 112.

Figure 6:
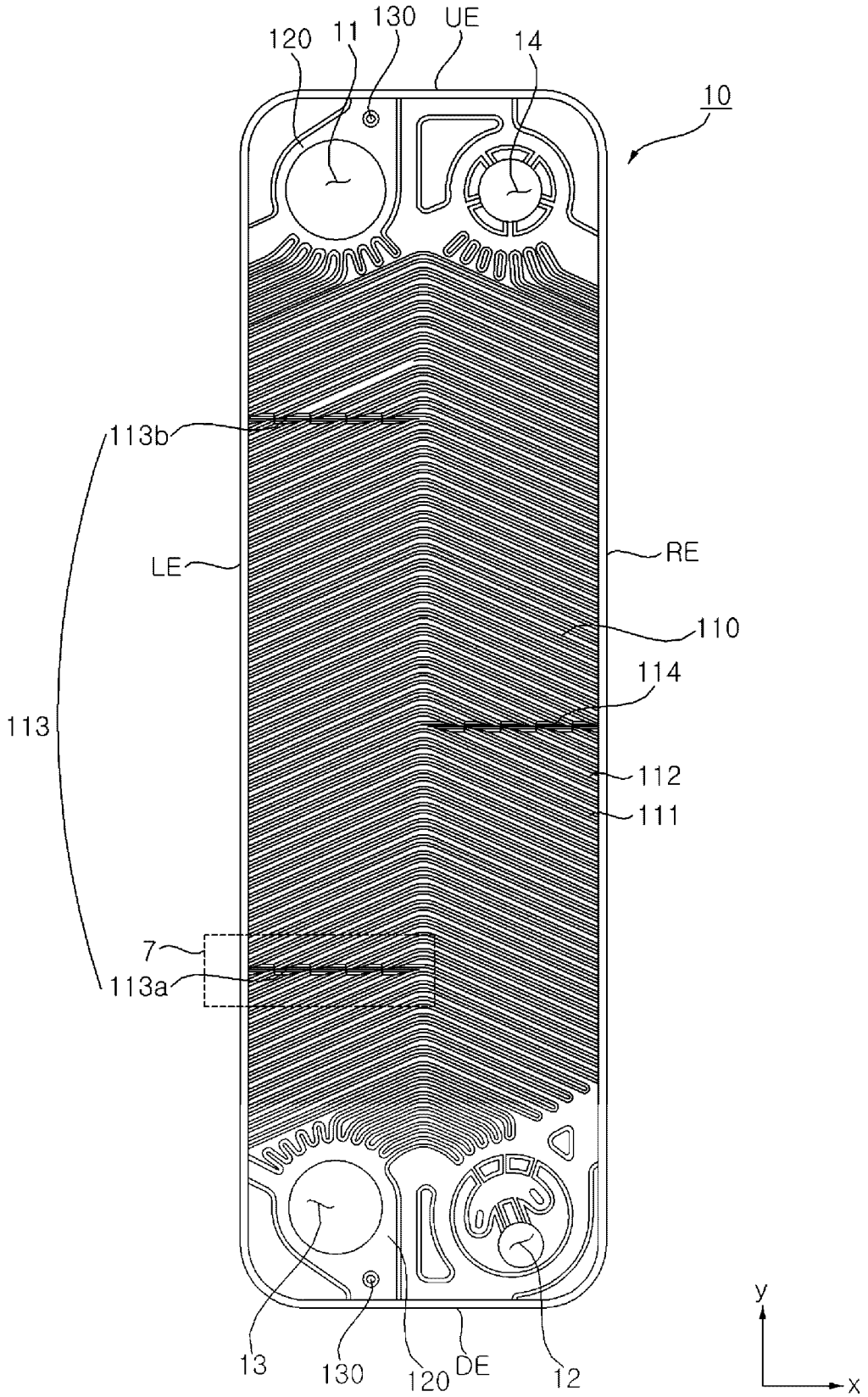
FIG. 6 is a front view of a first plate according to another embodiment of the present disclosure.
Figure 7:
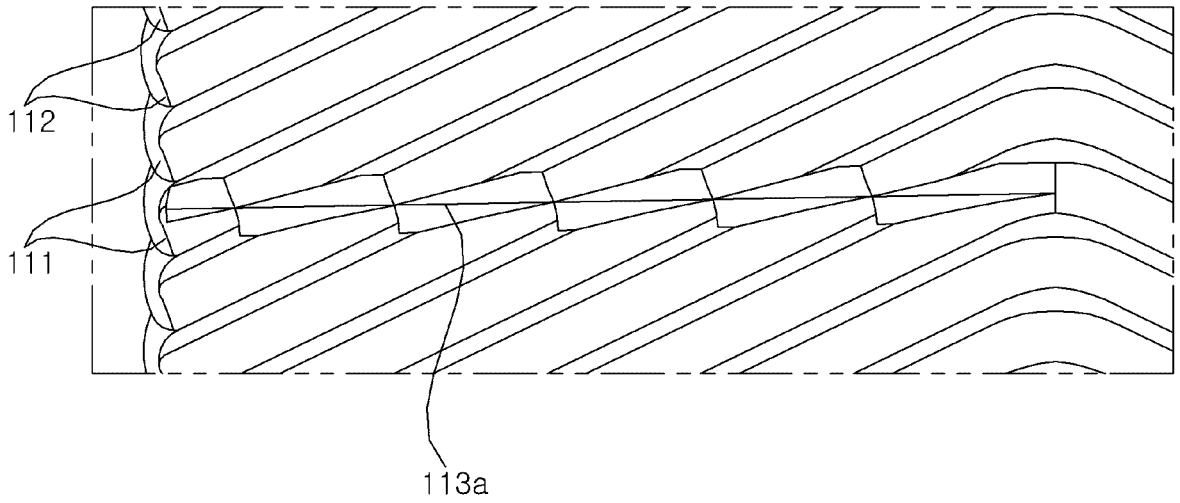
FIG. 7 is an enlarged view of part 7 of FIG. 6.

FIG. 6 is a front view of a first plate 10 according to another embodiment of the present disclosure, and FIG. 7 is an enlarged view of part 7 of FIG. 6.

Compared to the first plate 10 of FIG. 2A, the first plate 10 according to another embodiment of the present disclosure has a difference in that the first plate 10 according to another embodiment further includes a plurality of guide ribs 113 and 114. Hereinafter, a description will be made focusing on the differences from FIG. 2A, and parts without special explanation are considered to be the same as the embodiment of FIG. 2A.

The guide ribs 113 and 114 may include left guide ribs 113*a* and 113*b* and a right guide rib 114. At least two guide ribs 113 and 114 may be provided. The guide ribs 113 and 114 may be located in the first heat transfer region 110.

The guide ribs 113 and 114 may extend in a direction crossing the ridge 111 and the groove 112. The guide ribs 113 and 114 may have a step with respect to the groove 112. Thus, the fluid flowing through the groove 112 is blocked.

The left guide ribs 113*a* and 113*b* may extend in a direction crossing the vertical direction. Preferably, the left guide ribs 113*a* and 113*b* may extend in a horizontal direction.

One end of each of the left guide ribs 113*a* and 113*b* may be connected to the left end LE of the first plate 10. The other end of each of the left guide ribs 113*a* and 113*b* may be spaced apart from the right end RE of the first plate 10. Specifically, the left ends of the left guide ribs 113*a* and 113*b* may be connected to the left end LE of the first plate 10, and the right ends of the left guide ribs 113*a* and 113*b* may be located at a boundary between the left region S1 of the first plate 10 and the right region S2.

At least two left guide ribs 113*a* and 113*b* may be located to be spaced apart in the up-down direction.

The right guide rib 114 may extend in a direction crossing the vertical direction. Preferably, the right guide rib 114 may extend in the horizontal direction.

One end of the right guide rib 114 may be connected to the right end RE of the first plate 10. The other end of the right guide rib 114 may be spaced apart from the left end LE of the first plate 10. Specifically, the right end of the right guide rib 114 is connected to the right end RE of the first plate 10, and the right end of the right guide rib 114 may be located at a boundary between the left region S1 and the right region S2 of the first plate.

At least one right guide rib 114 may be disposed. The left guide ribs 113*a* and 113*b* and the right guide rib 114 may be arranged so as not to overlap each other in the vertical direction. In another embodiment, the left guide ribs 113*a* and 113*b* and the right guide rib 114 may overlap in the vertical direction within 30% of each other's length.

The left guide ribs 113*a* and 113*b* and the right guide rib 114 may be disposed at different heights. The right guide rib 114 may be located between the two left guide ribs 113*a* and 113*b*.

Since the first fluid W introduced through the first inlet 13 passes through the left guide ribs 113*a* and 113*b* and the right guide rib 114 to form a zigzag channel, the channel through which the first fluid W passes becomes longer, and the heat exchange efficiency increases.

The effect of the air conditioner according to the present disclosure is described as follows.

According to at least one of the embodiments of the present disclosure, freezing and bursting can be prevented by resolving stagnation of the flow of water adjacent to the inlet of the first fluid.

According to at least one of the embodiments of the present disclosure, since the flat portion surrounding the inlet has an asymmetric shape, the pressure of the fluid introduced from the inlet and the action of gravity is operated to move the fluid in one direction, and thus, the fluid stagnation can be prevented by simple shape change.

According to at least one of the embodiments of the present disclosure, the boundary BL between the first lower channel region and the first heat transfer region is inclined upward toward the right end of the first plate, there is an advantage in reducing the amount of first fluid that is stagnant under the groove spaced apart from the first inlet in the flow direction.

According to at least one of the embodiments of the present disclosure, the boundary BL between the first lower channel region and the first heat transfer region is inclined upward toward the right end of the first plate, and thus, it is possible to prevent an increase in welding areas of the first plate and the second plate and prevent fluid leakage.

A further scope of applicability of the present disclosure will become apparent from the detailed description above. However, since various changes and modifications within the spirit and scope of the present disclosure can be clearly understood by those skilled in the art, the detailed description and specific embodiments such as preferred embodiments of the present disclosure should be understood as given only as examples.

The above-described features, configurations, effects, and the like are included in at least one of the embodiments of the present disclosure, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as including in the scope and spirit of the disclosure as disclosed in the accompanying claims.

What is claimed is:

1. A plate heat exchanger comprising:

a first plate including:

a first heat transfer region configured to allow a first fluid to flow therethrough, the first heat transfer region having a groove;

a first inlet configured to introduce the first fluid into the first heat transfer region;

a first discharge portion configured to discharge the first fluid from the first heat transfer region; and a flat portion surrounding the first inlet, the flat portion having an asymmetrical shape with respect to the first inlet; and a second plate including:

a second heat transfer region configured to allow a second fluid to flow therethrough;

a second inlet configured to introduce the second fluid into the second heat transfer region; and a second discharge portion configured to discharge the second fluid from the second heat transfer region, the second plate being stacked on the first plate, wherein the flat portion includes:

a first region located between a center of the first inlet and the groove; and a second region other than the first region, wherein the second region includes:

a first boundary surface having a first end adjacent to a first end of the first plate and a second end connected to the groove; and a second boundary surface having a first end adjacent to the first end of the first plate, wherein a distance between the first boundary surface and the second boundary surface increases in a left-direction as the distance between the first boundary surface and the second boundary surface approaches from the first end of the first plate to the center of the first inlet, wherein a portion of the first boundary surface has a straight-line shape, and wherein a portion of the second boundary surface has a curved shape.

2. The plate heat exchanger of claim 1, wherein the first heat transfer region includes a ridge, wherein the groove has a height difference with respect to the ridge, and wherein the flat portion has a height difference with respect to the ridge.

3. The plate heat exchanger of claim 2, wherein the flat portion is located on a same plane as a bottommost point of the groove.

4. The plate heat exchanger of claim 1, wherein a width of the first region between the first inlet and the groove is maintained constant along a periphery of the first inlet.

5. The plate heat exchanger of claim 1, wherein the second region has a shape that is asymmetric in a left-right direction with respect to the center of the first inlet.

6. The plate heat exchanger of claim 1, wherein the first boundary surface extends in a direction perpendicular to the first end of the first plate.

7. The plate heat exchanger of claim 1, wherein the second boundary surface extends at an acute angle of inclination with respect to the first end of the first plate.

8. The plate heat exchanger of claim 7, wherein the acute angle of inclination is 25 degrees to 35 degrees.

9. The plate heat exchanger of claim 1, wherein the second region further includes a third boundary surface connecting the first end of the first boundary surface to the first end of the second boundary surface.

10. The plate heat exchanger of claim 1, wherein the first boundary surface does not overlap the first inlet in a vertical direction.

11. The plate heat exchanger of claim 1, wherein a portion of the second boundary surface overlaps the first inlet in a vertical direction.

12. The plate heat exchanger of claim 1, wherein the first plate further includes a protrusion protruding from the flat portion, the protrusion being located between the first boundary surface and the second boundary surface.

13. The plate heat exchanger of claim 12, wherein the protrusion overlaps the first inlet in a vertical direction.

14. The plate heat exchanger of claim 2, wherein the first plate further includes a first channel region connected to a first end of the first heat transfer region, the first channel region including:

the first inlet; and a low-temperature fluid flow portion located in the first channel region, the low-temperature fluid flow portion being configured to allow the second fluid to pass therethrough, and wherein a boundary between the first channel region and the first heat transfer region at the low-temperature fluid flow portion is inclined upward toward a side of the first plate.

15. The plate heat exchanger of claim 1, wherein the first heat transfer region is located between the first inlet and the first discharge portion.

16. A plate heat exchanger comprising:

a first plate including:

a first heat transfer region configured to allow a first fluid to flow therethrough, the first heat transfer region having a groove;

a first inlet configured to introduce the first fluid into the first heat transfer region;

a first discharge portion configured to discharge the first fluid from the first heat transfer region; and a flat portion surrounding the first inlet, a width of the flat portion between a right side and a lower side of the first inlet is greater than a width of the flat portion on the right side of the first inlet and a width of the flat portion on a left side of the first inlet; and a second plate including:

a second heat transfer region configured to allow a second fluid to flow therethrough;

a second inlet configured to introduce the second fluid into the second heat transfer region; and a second discharge portion configured to discharge the second fluid from the second heat transfer region, the second plate being stacked on the first plate, wherein the flat portion includes:

a first region located between a center of the first inlet and the groove; and a second region other than the first region, wherein the second region includes:

a first boundary surface having a first end adjacent to a first end of the first plate and a second end connected to the groove; and a second boundary surface having a first end adjacent to the first end of the first plate, wherein a distance between the first boundary surface and the second boundary surface increases in a left-direction as the distance between the first boundary surface and the second boundary surface approaches from the first end of the first plate to the center of the first inlet, wherein a portion of the first boundary surface has a straight-line shape, and wherein a portion of the second boundary surface has a curved shape.

17. A plate heat exchanger comprising:

a first plate including:

a first heat transfer region configured to allow a first fluid to flow therethrough, the first heat transfer region having a groove;

a first inlet configured to introduce the first fluid into the first heat transfer region;

a first discharge portion configured to discharge the first fluid from the first heat transfer region; and a flat portion surrounding the first inlet, a width of the flat portion is maximum in a direction between a right side and a lower side of the first inlet; and a second plate including:

a second heat transfer region configured to allow a second fluid to flow therethrough;

a second inlet configured to introduce the second fluid into the second heat transfer region; and a second discharge portion configured to discharge the second fluid from the second heat transfer region, the second plate being stacked on the first plate, wherein the flat portion includes:

a first region located between a center of the first inlet and the groove; and a second region other than the first region, wherein the second region includes:

a first boundary surface having a first end adjacent to a first end of the first plate and a second end connected to the groove; and a second boundary surface having a first end adjacent to the first end of the first plate, wherein a distance between the first boundary surface and the second boundary surface increases in a left-direction as the distance between the first boundary surface and the second boundary surface approaches from the first end of the first plate to the center of the first inlet, wherein a portion of the first boundary surface has a straight-line shape, and wherein a portion of the second boundary surface has a curved shape.

* * * * *